US007195410B2

(12) United States Patent
Yoshida et al.

(10) Patent No.: US 7,195,410 B2
(45) Date of Patent: Mar. 27, 2007

(54) PRINTING APPARATUS HAVING MEANS FIXING INK RIBBON UNIT AND INTERMEDIATE TRANSFER SHEET UNIT IN PRINTER BODY

(75) Inventors: Yuuki Yoshida, Saitama (JP); Tatsuo Shiaku, Saitama (JP); Junichi Mizukami, Saitama (JP); Naoki Yoshida, Tokyo (JP)

(73) Assignee: Teac Corporation, Tokyo (JP)

( * ) Notice: Subject to any disclaimer, the term of this patent is extended or adjusted under 35 U.S.C. 154(b) by 251 days.

(21) Appl. No.: 10/978,240

(22) Filed: Oct. 29, 2004

(65) Prior Publication Data

US 2005/0095049 A1 May 5, 2005

(30) Foreign Application Priority Data

Oct. 31, 2003 (JP) ..... 2003-373080

(51) Int. Cl.
*B41J 2/325* (2006.01)

(52) U.S. Cl. ..... 400/120.01; 400/208; 400/692; 347/213; 347/222

(58) Field of Classification Search ..... 400/120.01, 400/120.04, 207, 208, 208.1, 691, 692, 693, 400/613, 614; 347/222, 213, 214
See application file for complete search history.

(56) References Cited

U.S. PATENT DOCUMENTS 5,431,504 A * 7/1995 Beadman et al. ..... 400/692

FOREIGN PATENT DOCUMENTS

JP 07-61009 A * 3/1995
JP 9-66617 A * 3/1997
JP 2002 337369 11/2002
JP 2005-246873 A * 9/2005

* cited by examiner

*Primary Examiner*—Leslie J. Evanisko
(74) *Attorney, Agent, or Firm*—Weingarten, Schurgin, Gagnebin & Lebovici LLP

(57) ABSTRACT

The printing apparatus comprises a first detachable unit U1, a second detachable unit U2, and a main body unit U5 formed such that the first and second detachable units U1 and U2 are detachably mounted thereto. When a unit fixing means 33 provided on a head unit U3 of the main body unit rotates in a clockwise direction to be laid horizontally and then a boss 36 is fitted into a concave portion 33A, the head unit U3 and a pinch roller unit U4 are connected to each other through the unit fixing means. The first detachable unit is pressed by a left end of the unit fixing means, and the second detachable unit is pressed by a right end of the unit fixing means. As a result, it is possible to prevent the first and second detachable units from separating from the main body unit forward. In addition, when the unit fixing means is rotated in a counterclockwise direction to be upwardly constructed, the first detachable unit U1 and the second detachable unit U2 can be mounted detachably to the main body unit.

6 Claims, 9 Drawing Sheets

Fig. 9 ---Prior Art---
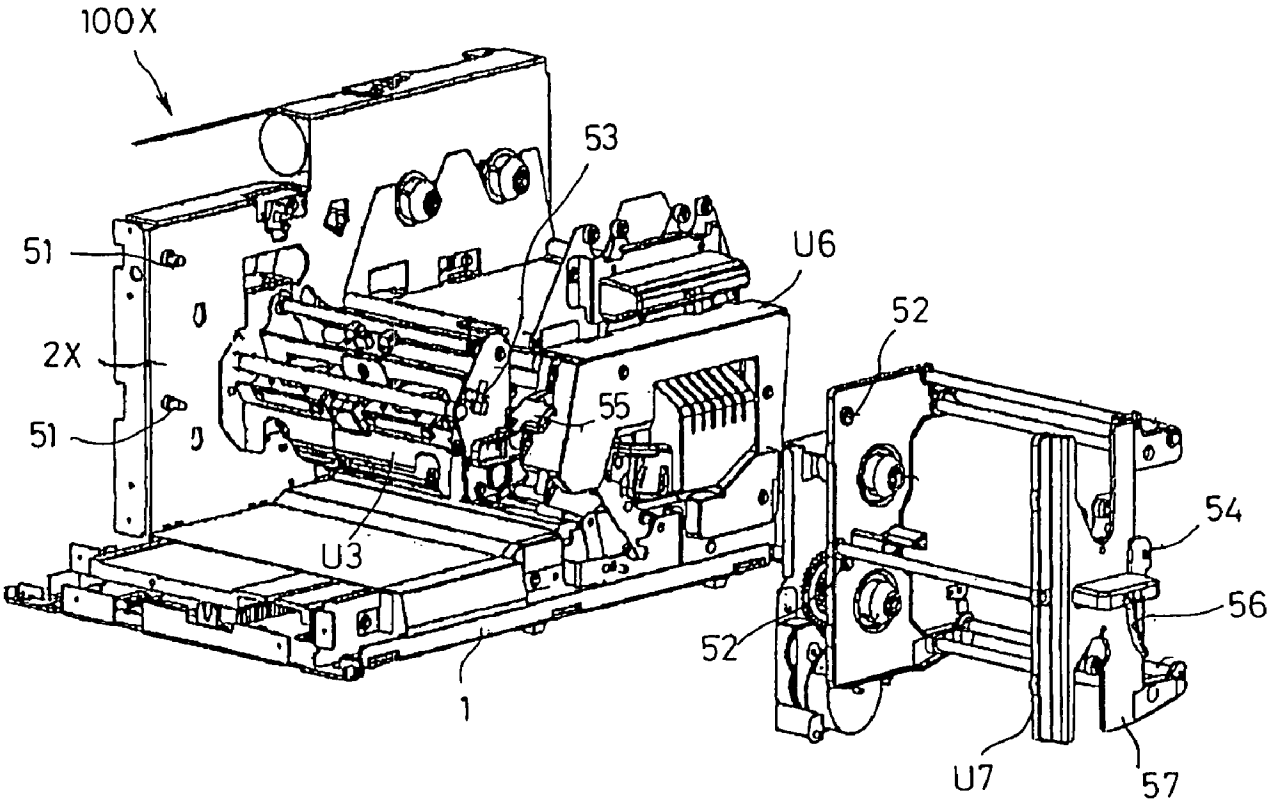

PRINTING APPARATUS HAVING MEANS FIXING INK RIBBON UNIT AND INTERMEDIATE TRANSFER SHEET UNIT IN PRINTER BODY

This application claims priority to a Japanese application No. 2003-373080 filed Oct. 31, 2003.

BACKGROUND OF THE INVENTION

1. Field of the Invention

The present invention relates to a printing apparatus in which an ink ribbon having a plurality of monochromatic inks of different colors is repeatedly arranged in a longitudinal direction on a sheet is used, an image to be transferred is formed on an intermediate transfer sheet serving as a recording medium, the image to be transferred on the intermediate transfer sheet is transferred on a printed matter, and a desired image is formed on a printed matter such as a disk, a card and the like.

2. Description of the Related Art For this type of printing apparatus, for example, a printing apparatus 100X has been known, as shown in FIG. 9 (for example, see Patent Document 1)

Specifically, in the printing apparatus 100X, a head unit U3 and an intermediate transfer unit U6 are mounted on a supporting plate 2X upwardly constructed on a rear portion of a chassis 1 (described as a frame in Patent Document 1). In addition, a ribbon unit U7 is detachably mounted in the supporting plate 2X.

Further, by making heater elements of a thermal head (not shown) of the head unit U3 emit heat selectively, an ink of an ink ribbon wound on a ribbon roller (not shown) of the ribbon unit U7 mounted on the supporting plate 2X is melted, and transferred to an intermediate transfer body (not shown) of an intermediate transfer unit U6. Thus, the ink transferred again to a predetermined printed matter. Thereafter a desired printing is performed.

Furthermore, the afore-mentioned printing apparatus 100X is constructed such that the head unit U3 is supported by the supporting plate 2X in a cantilever manner. In addition, positioning projections 51 provided on the supporting plate 2X are fitted into positioning holes 52 of the ribbon unit U7, a positioning projection 53 of the head unit U3 is fitted into a positioning hole 54 of the ribbon unit U7, and a stopper lever 55 of the head unit U3 is rotated so as to make one end of the stopper lever 55 to be engaged with an engagement portion 56 of the ribbon unit U7. As a result, the ribbon unit U7 is fixed on the chassis 1.

According to the printing apparatus having the above-mentioned structure, since the other side of the head unit U3, which is supported in a cantilever manner, is supported by a supporting frame 57 of the ribbon unit U7, the head unit U3 can be reliably supported.

[Patent Document 1] Japanese Unexamined Patent Application Publication No. 2002-337369

However, according to the above-mentioned printing apparatus disclosed in Patent Document 1, it is required that, even though the intermediate transfer body of the intermediate transfer unit is a long intermediate transfer sheet wound on a sheet bobbin, the intermediate transfer sheet be easily detachable, and a portion that holds the intermediate transfer sheet be reliably supported, similarly to the head unit.

SUMMARY OF THE INVENTION

Accordingly, the present invention is designed to solve the above-mentioned problems, and thus an object of the present invention is to provide a printing apparatus in which even though an intermediate transfer sheet is long, the intermediate transfer sheet can be easily attachable and detachable, and a part holding the intermediate transfer sheet can be reliably supported, similarly to a head unit.

In order to achieve the object, according to the present invention, there is provided a printing apparatus which comprises a main body unit for performing recording on a printed matter and a first detachable unit and a second detachable unit provided detachably in the main body unit. The printing apparatus further comprises an unit fixing means attached to at least one of the main body unit the first detachable unit and the second detachable unit, the unit fixing means is switchable to a lock position to engage with the remaining units so that the first and second detachable units are fixed to the main body unit and to an unlock position at which the first and second detachable units are detachably mounted to the main body unit.

Further, when the unit fixing means is switchable to the lock position, the main body unit, the first removable means and the second removable means are connected to each other through the unit fixing means to thus be fixed. In addition, when the unit fixing means is switchable to the unlock position, the first and second detachable units are attachable to the main body unit and detachable from the main body unit. Therefore, the attachment and detachment of the first and second detachable units to and from the main body unit can be easily performed. Further the first and second detachable units can be reliably attached to the main body unit.

A printing apparatus comprises a main body unit for performing recording on a printed matter, a first detachable unit and a second detachable unit provided detachably in the main body unit and unit fixing means attached to at least one of the main body unit, the first detachable unit and the second detachable unit. The unit fixing means is switchable to a lock position at which the unit fixing means engages with the remaining units to connect three units to each other so that the first and second detachable units are fixed to the main body unit and to an unlock position at which the first and second detachable units are detachably mounted to the main body unit. In addition, the main body unit comprises a chassis, a head unit for transferring an ink of an ink ribbon on an intermediate transfer sheet serving as a recording medium an end supported by the chassis in a cantilever manner, and a pinch roller unit for guiding the ink ribbon and/or the intermediate transfer sheet an end supported by the chassis in a cantilever manner. In addition, the first detachable unit comprises the ink ribbon, the second detachable unit comprises the intermediate transfer sheet, and the unit fixing means comprises connecting means for connecting or disconnecting the other end of the head unit to or from the other end of the pinch roller unit. When the unit fixing means is switchable to the lock position, the other end of the head unit and the other end of the pinch roller unit are connected to each other through the connecting means so that the first and second detachable units are fixed to the main body unit so as not to be detached therefrom. When the unit fixing means is switchable into the unlock position, the other end of the head unit and the other end of the pinch roller unit are disconnected from each other so that the first and second detachable units are detachably mounted to the main body unit.

BRIEF DESCRIPTION OF THE DRAWINGS

FIG. 9 is an explanatory view of a conventional art.

DESCRIPTION OF THE PREFERRED EMBODIMENT

First Embodiment

Figure 1:
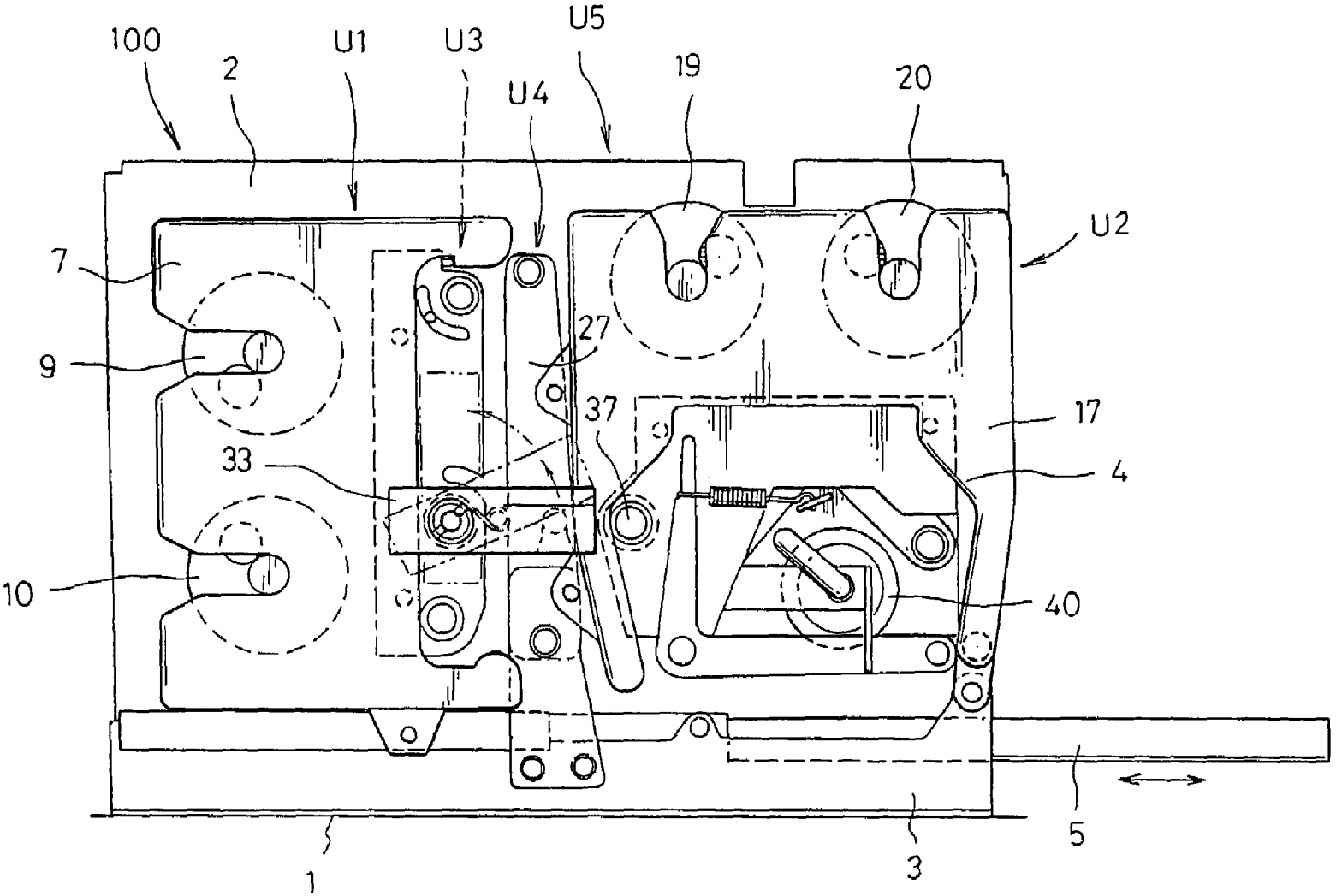
FIG. 1 is an explanatory view of a printing apparatus of the present invention as seen from the front side thereof.
Figure 2:
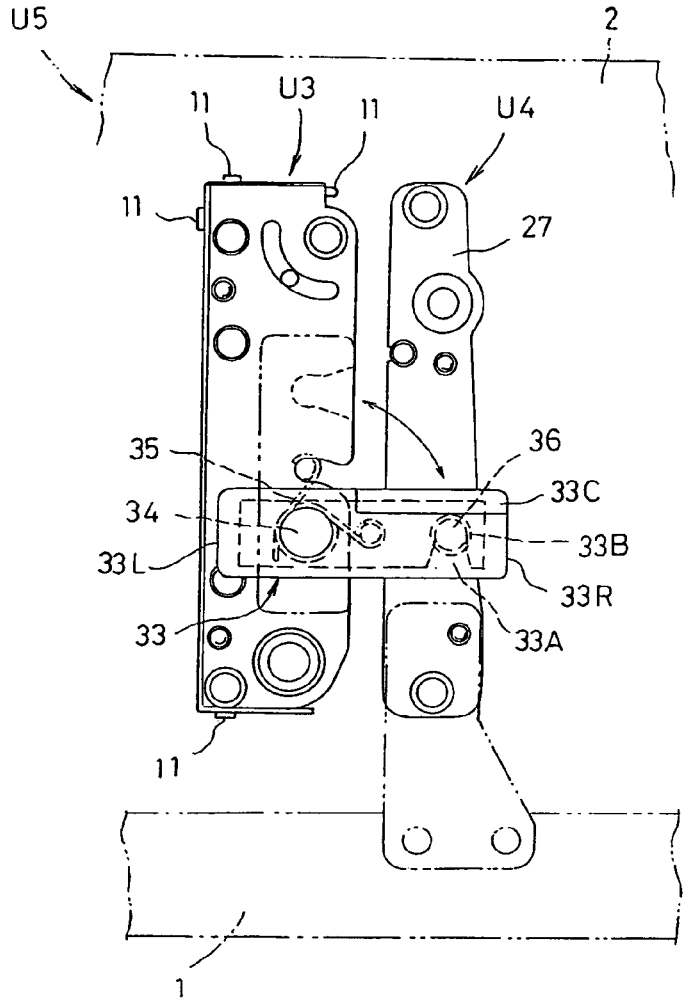
FIG. 2(A) and FIG. 2(B) are explanatory views of an essential element (unit fixing means) of the printing apparatus of the present invention, FIG. 2(A) being an explanatory view of the main portion of the printing apparatus as seen from the front side thereof, and FIG. 2(B) being an explanatory view of the main portion of the printing apparatus as seen from the upper side thereof.
Figure 2:
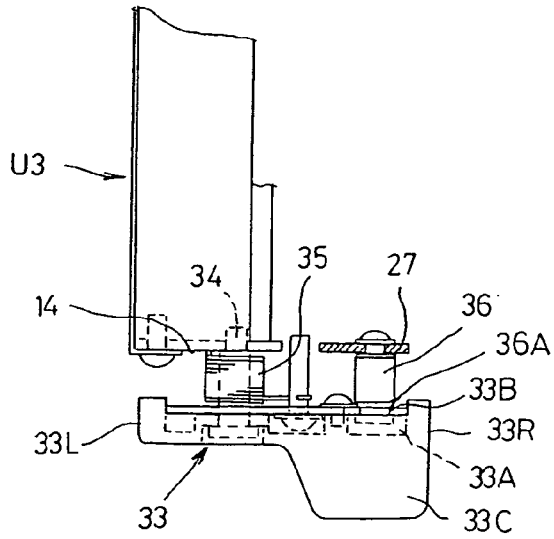
Figure 3:
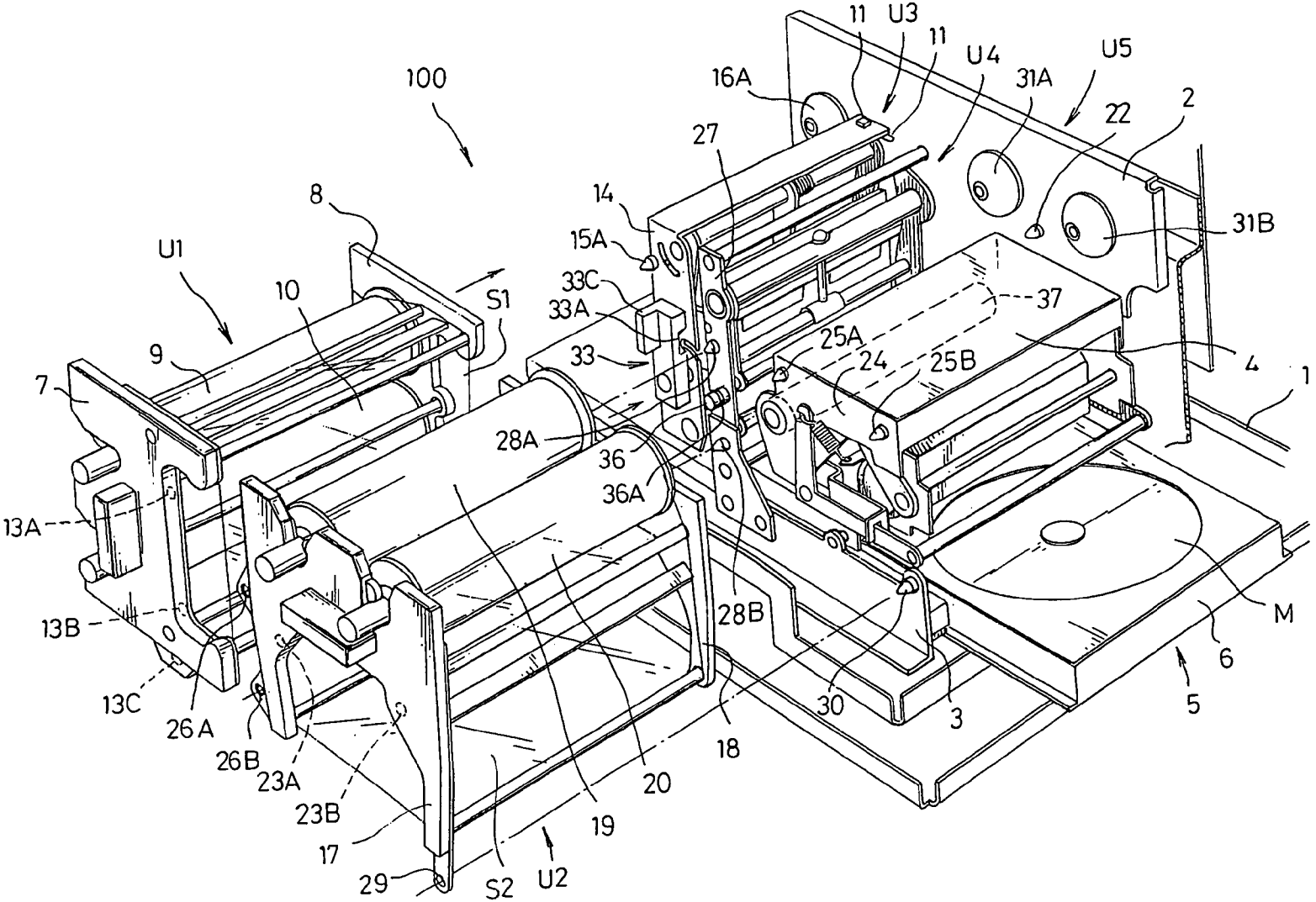
FIG. 3 is an explanatory view of the printing apparatus of the present invention in a state in which a first detachable unit and a second detachable unit are disconnected from a main body unit.
Figure 4:
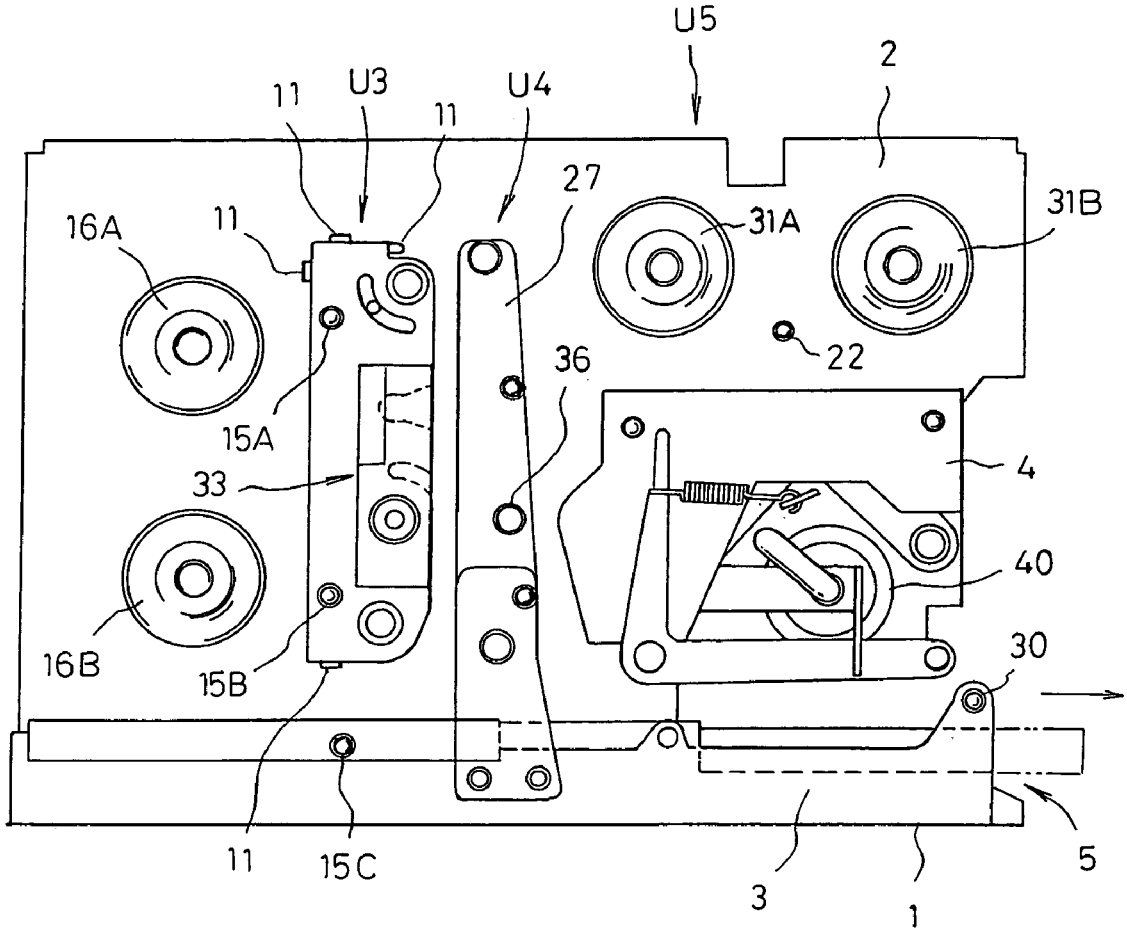
FIG. 4 is an explanatory view of an essential element (main body unit) of the printing apparatus of the present invention.
Figure 5:
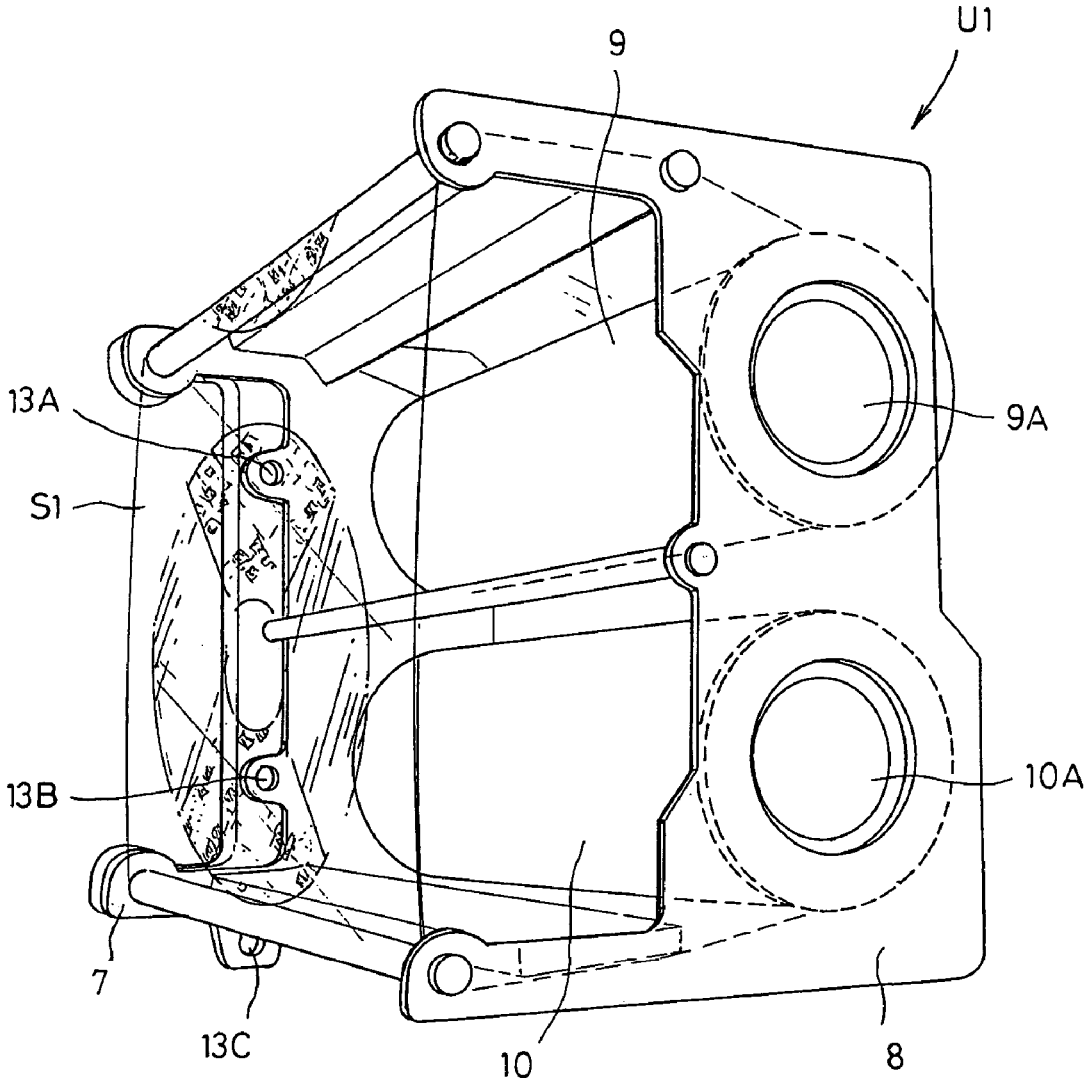
FIG. 5 is an explanatory view of an essential element (first detachable unit) of the printing apparatus of the present invention.
Figure 6:
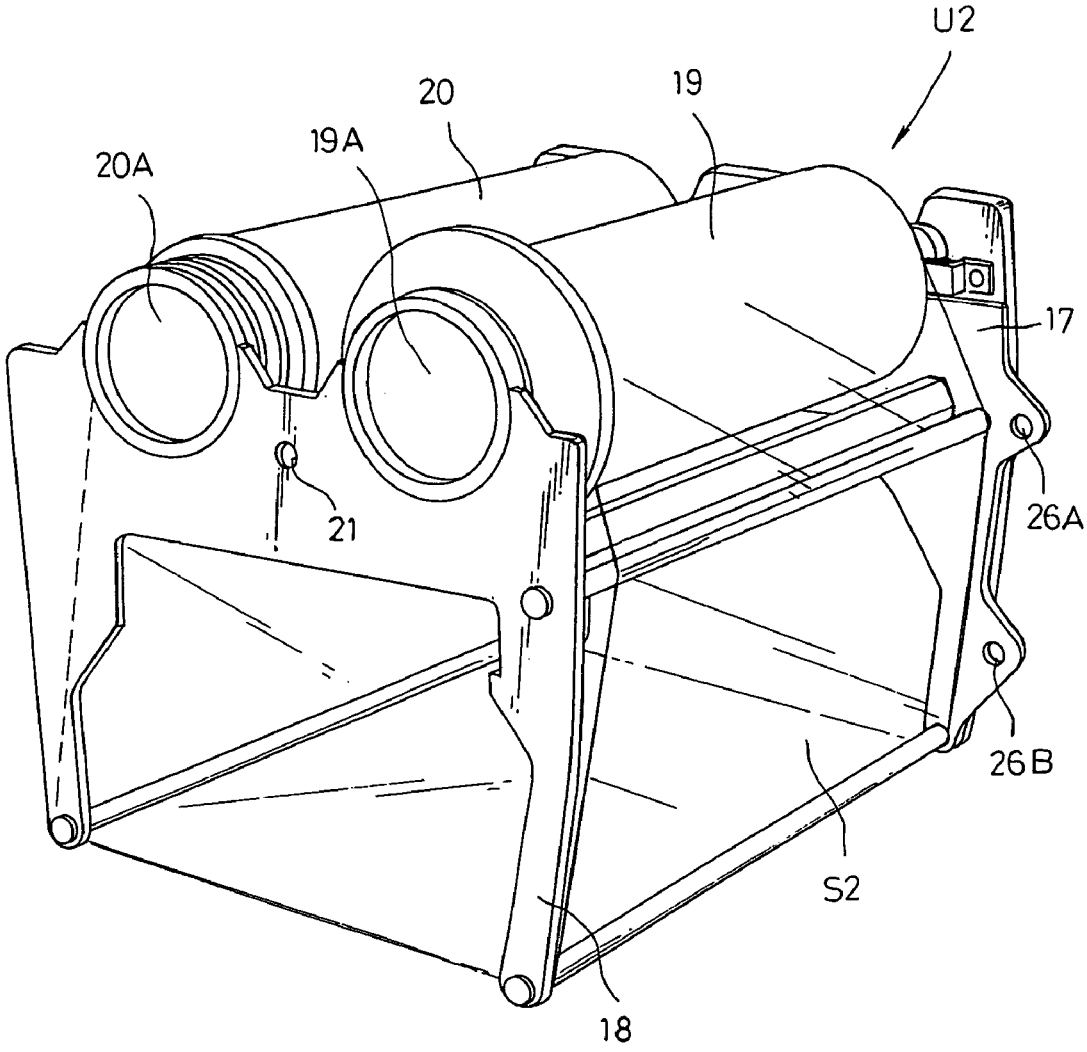
FIG. 6 is an explanatory view of an essential element (second detachable unit) of the printing apparatus of the present invention.

An embodiment of the present invention will be described with reference to FIGS. 1 to 8. As shown in FIG. 1, a printing apparatus 100 of the present invention comprises a first detachable unit U1 having an ink ribbon cassette, a second detachable unit U2 having an intermediate transfer sheet cassette, and a main body unit U5 in which the first detachable unit U1 and the second detachable unit U2 are detachably formed.

The main body unit U5 has a chassis 1 that a vertical supporting plate 2 stands up on a rear side thereof, and a head unit U3 and a pinch roller unit U4 are mounted in a front side of the vertical supporting plate 2 so as to be supported in a cantilever manner. In addition, image transfer means 4 and printed matter carrying means 5 are mounted in the chassis 1. The printed matter carrying means 5 is arranged at a lower side of the image transfer means 4 such that a tray 6 can move in a horizontal direction. In addition, by the printed matter carrying means 5, a printed matter M, such as a CD and a DVD mounted in the tray 6, is arranged under the image transfer means 4 at a right side of the printing apparatus so that the printed matter M can be carried out from the right side of the printing apparatus after the image is transferred onto the printed matter M.

The first detachable unit U1 comprises a front-side vertical plate 7 (in detail, a plate obtained by bonding a relatively thin steel plate to a relatively thick resin plate), a back-side vertical plate 8, and an ink ribbon feeding bobbin 9 and an ink ribbon winding bobbin 10 that are rotatably bridged between the front-side vertical plate 7 and the back-side vertical plate 8 in upper and lower portions, respectively. The first detachable unit U1 is slid and pressed in a direction of arrow in FIG. 3 using the head unit U3 as a guide so that the first detachable unit U1 abuts with convex portions 11 which protrude vertically and horizontally at the vertical supporting plate 2 side of the head unit U3. As a result, the vertical supporting plate 2 side, that is, a rear side of the first detachable unit U1 is positioned. Further, two upper and lower engaging and fixing bosses 15A and 15B formed in the front-side vertical plate 14 of the head unit U3, and an engaging and fixing boss 15C that is provided on a front side of the chassis 1 are fitted into three engaging and fixing holes 13A, 13B and 13C that are vertically formed in the front-side vertical plate 7. As a result, the front side of the first detachable unit U1 is positioned. When the front side thereof is positioned so as to be supported to the chassis 1, a circular recess portion 9A formed in a rear side of the ink ribbon feeding bobbin 9 and a circular recess portion 10A formed in a rear side of the ink ribbon winding bobbin 10 are fitted to two upper and lower rotary shafts 16A and 16B that protrude at a front side of the vertical supporting plate 2 so as to have a bowl shape, so that the first detachable unit U1 is attached to the main body unit U5.

Further, the lower rotary shaft 16B is driven by a motor (not shown) so that the lower ink ribbon winding bobbin 10 is rotatably driven. In this case, an ink ribbon S1 that is wound on the ink ribbon feeding bobbin 9 by the ink ribbon winding bobbin 10 which is rotating is wounded on the ink ribbon winding bobbin 10 via a part of the head unit U3 by a plurality of guide rollers.

The second detachable unit U2 comprises a front-side vertical plate 17 (in detail, a plate obtained by bonding a relatively thin steel plate to a relatively thick resin plate), a back-side vertical plate 18, and an intermediate-transfer sheet feeding bobbin 19 and an intermediate transfer sheet winding bobbin 20 that are rotatably bridged between the front-side vertical plate 17 and the back-side vertical plate 18 in right and left portions, respectively. The second detachable unit U2 is slid and pressed in a direction of arrow in FIG. 3 using the image transfer means 4 as a guide so that an engaging and fixing boss 22 that is provided on a front side of the vertical supporting plate 2 is fitted into an engaging and fixing hole 21 that is formed in a back-side vertical plate 18. As a result, the vertical supporting plate 2 side, that is, the rear side of the second detachable unit U2 is positioned. Further, two left side and right side engaging and fixing bosses 25A and 25B that are provided on the front-side vertical plate 24 of the image transfer means 4 are fitted into two left side and right side engaging and fixing holes 23A and 23B that are formed in a central stage portion of the front-side vertical plate 17, two upper and lower engaging and fixing bosses 28A and 28B that are provided on the front-side vertical plate 27 of the pinch roller unit U4 are fitted into two upper and lower engaging and fixing holes 26A and 26B formed at the left side of the front-side vertical plate 17, and a front side engaging and fixing boss 30 of the front side vertical supporting plate 3 mounted on the chassis 1 is fitted into an engaging and fixing hole 29 that is formed below the right side of the front-side vertical plate 17. As a result, the front side of the second detachable unit U2 is positioned.

Further, when the second detachable unit U2 is positioned as mentioned above, a circular recess portion 19A formed at a rear side of the intermediate transfer sheet feeding unit 19 and a circular recess portion 20A formed at a rear side of the intermediate transfer sheet winding bobbin 20 are fitted to two left side and right side rotary shafts 31A and 31B that protrude at a front side of the vertical supporting plate 2 in a bowl shape, so that the second detachable unit U2 is attached to the main body unit U5.

In the case of the second detachable unit U2, two left side and right side rotary shafts 31A and 31B are suitably driven by driving two motors (not shown) selectively. In this case, an intermediate transfer sheet S2 that is wound on the intermediate-transfer sheet feeding bobbin 19 can be wounded on the intermediate transfer sheet winding bobbin 20 via parts of the pinch roller unit U4 and image transfer means 4 by a plurality of guide rollers. To the contrary, the intermediate transfer sheet S2 can be rewound on the intermediate-transfer sheet feeding bobbin 19 from the intermediate transfer sheet winding bobbin 20.

Further, unit fixing means 33 is pivotally attached to the front-side vertical plate 14 of the head unit U3 by a supporting shaft 34 and is rotatable in a vertical plane of the front-side vertical plate 14. The supporting shaft 34 is provided with a spring 35 for biasing the unit fixing means 33 in a clockwise direction. Further, a concave portion 33A is formed in the unit fixing means 33. When the unit fixing means 33 rotates in the clockwise direction to be laid horizontally, the unit fixing means is eccentrically arranged toward a right end 33R indicating a direction of three o'clock so that a boss 36 provided on the front-side vertical plate 27 of the pinch roller unit U4 is fitted into the concave portion 33A.

Further, a fitting portion 33B composed of a thin plate, which can be loosely fitted into a circumferential groove 36A formed in the boss 36, is provided in a part corresponding to the concave portion 33A. When the fitting portion 33B is loosely fitted into the circumferential groove 36A of the boss 36, the right end 33R of the unit fixing means 33 is displaced in the back and forth direction of the unit fixing means 33 without misalignment. Further, the unit fixing means 33 is provided with an operating handle 33C.

Furthermore, when the unit fixing means 33 rotates in a clockwise direction to be laid horizontally, the unit fixing means 33 is provided to be relatively thin and long, the right end 33R indicating a direction of three o'clock is deviated from the front-side vertical plate 14 toward the right side so that the right end 33R protrudes to the second detachable unit U2 inserted and mounted in the main body unit U5, and a left end 33L indicating a direction of nine o'clock is away from the front-side vertical plate 14 toward the left side so that the left end 33L protrudes to the first detachable unit U1 inserted and mounted in the main body unit U5. In addition, the thin and long main body of the unit fixing means 33 that is formed so as to be thin and long becomes connecting means according to claim 2.

In addition, when the first detachable unit U1 and the second detachable unit U2 are inserted and mounted in the main body unit U5, the front surface of each of the first and second detachable units U1 and U2 is arranged on the same plane with the front surface of the front-side vertical plate 14 of the head unit U3 to which the unit fixing means 33 is pivotally attached or is arranged so as to be recessed as compared to the front surface of the front vertical plate 14 of the head unit U3.

Accordingly, the first detachable unit U1 and the second detachable unit U2 are mounted in the main body unit U5, the unit fixing means 33 is rotated in a clockwise direction to be laid horizontally, and the concave portion 33A is fitted into the boss 36. In this case, the head unit U3 and the pinch roller unit U4 are connected to each other through the unit fixing means 33, the front-side vertical plate 7 of the first detachable unit U1 is pressed by the left end 33L of the unit fixing means 33, and the front-side vertical plate 17 of the second detachable unit U2 is pressed by the right end 33R of the unit fixing means 33. As a result, it is possible to prevent the first and second detachable units U1 and U2 from separating from the main body unit U5 forwardly.

On the other hand, when the unit fixing means 33 is rotated in a counterclockwise direction to be upwardly constructed, the head unit U3 and the pinch roller unit U4 that are connected to each other through the unit fixing means 33 are disconnected from each other so that the first detachable unit U1 and the second detachable U2 are attachable to the main body unit U5 and are detachable from the main body unit U5.

In addition, when the first detachable unit U1 is mounted in the main body unit U5, the engaging and fixing bosses 15A and 15B are respectively fitted into the engaging and fixing holes 13A and 13B so that the front-side vertical plate 14 of the head unit U3 which is supported by the front side of the vertical supporting plate 2 in a cantilever manner is supported by the front-side vertical plate 7 of the first detachable unit U1, and the engaging and fixing boss 15C is fitted into the engaging and fixing hole 13C so that the front-side vertical plate 7 of the first detachable unit U1 is supported by the front side of the chassis 1. As a result, the front side of the head unit U3, which is supported by the front side of the vertical supporting plate 2 in a cantilever manner, is not bent downwardly due to a self-weight.

Figure 7:
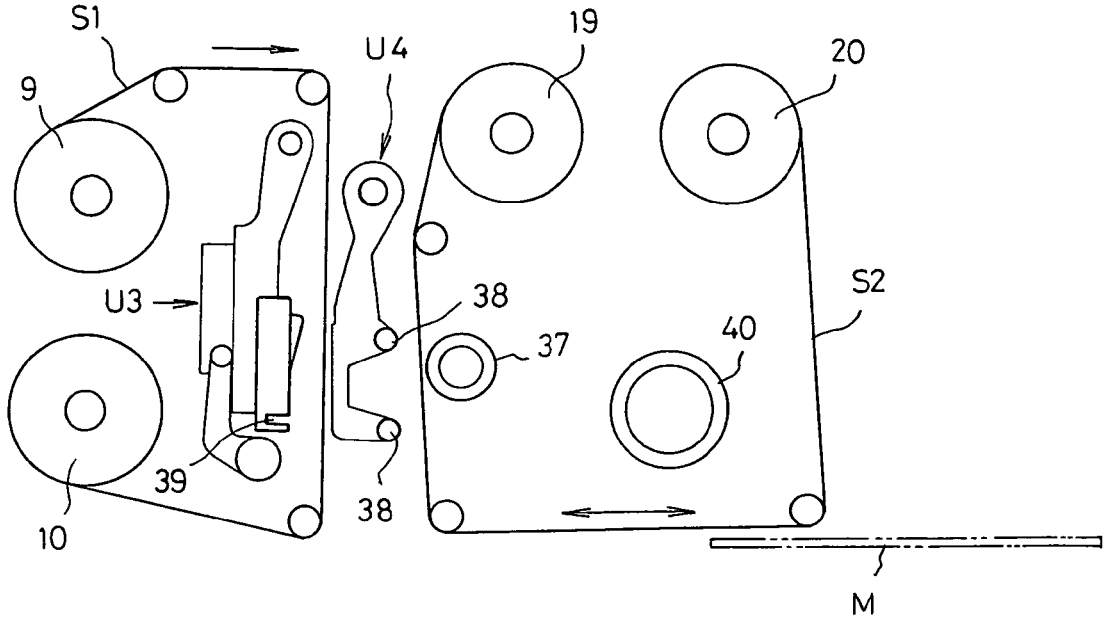
FIG. 7(A) and FIG. 7(B) are explanatory views of an image forming portion of the printing apparatus of the present invention, FIG. 7(A) being an explanatory view showing a waiting state, and FIG. 7(B) being an explanatory view showing a state in which ink is transferred onto an intermediate transfer sheet from an ink ribbon.
Figure 7:
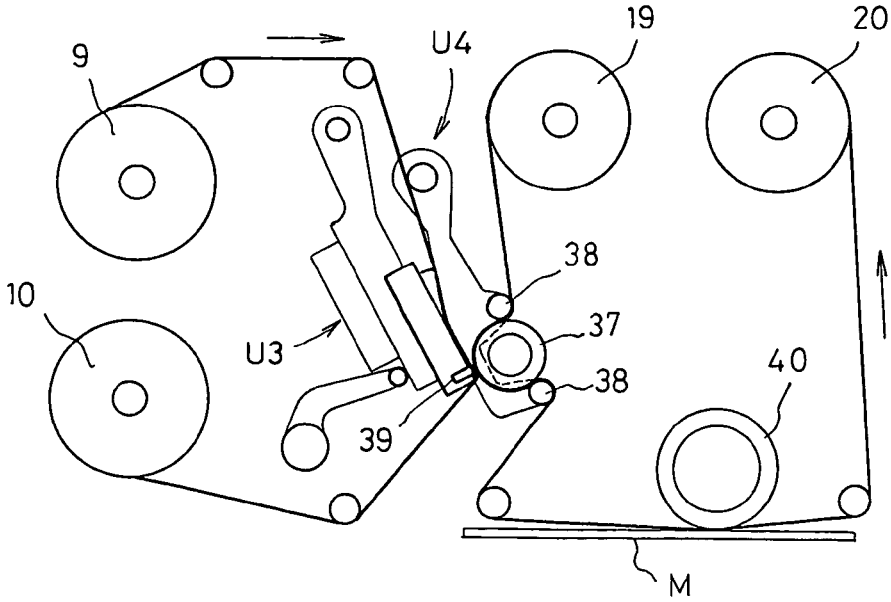
Figure 8:
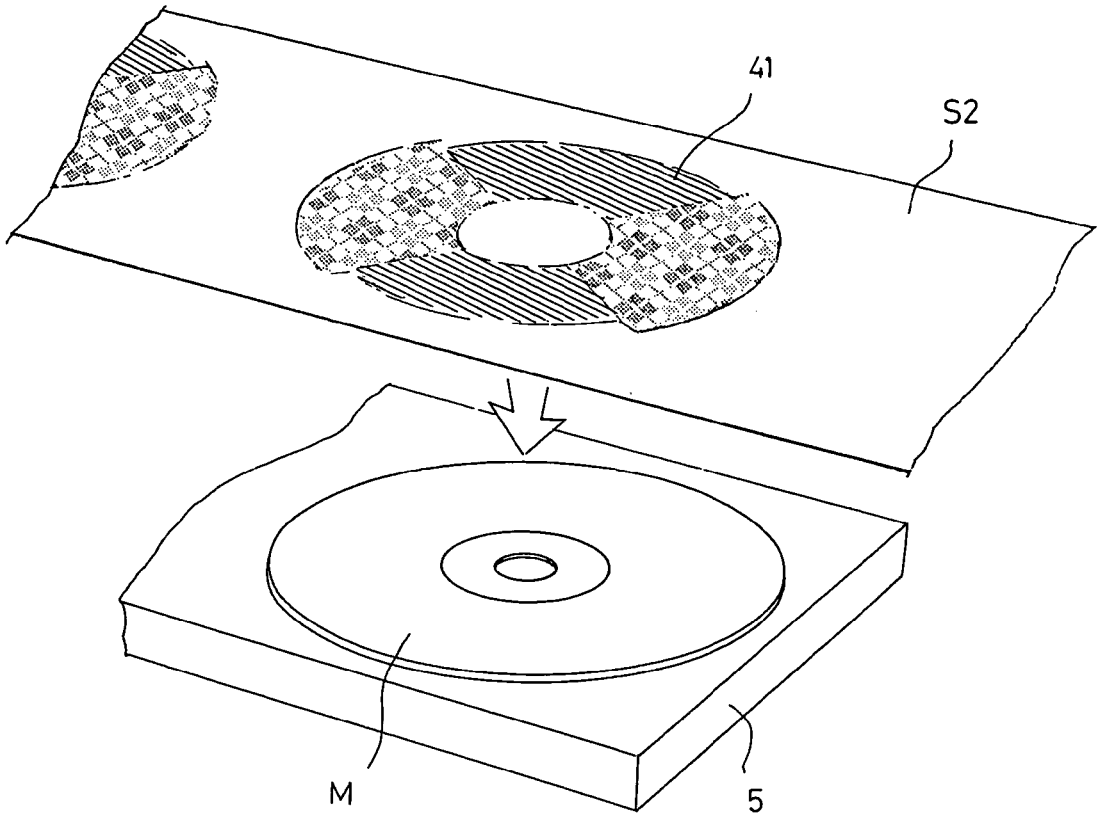
FIG. 8(A) and FIG. 8(B) are explanatory views showing a state in which printing is performed, FIG. 8(A) being an explanatory view showing a state in which an image is transferred onto a printed matter from the intermediate transfer sheet, and FIG. 8(B) being an explanatory view of the printed matter on which the image is printed.
Figure 8:
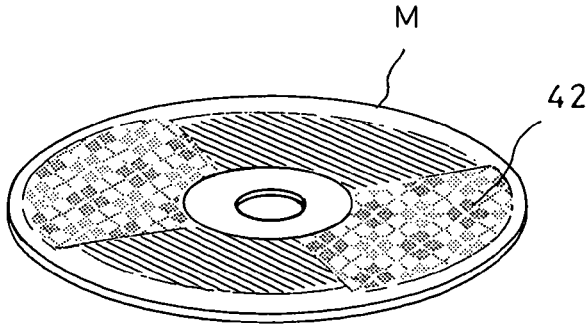

As shown in FIG. 7, according to the printing apparatus 100 of the present invention having the above-mentioned structure, an ink ribbon S1 that is wound on the ink ribbon winding bobbin 10 from the ink ribbon feeding bobbin 9 is guided by a plurality of guide rollers to pass through the part of the head unit U3. In addition, an intermediate transfer sheet S2 that is wound on the intermediate transfer sheet winding bobbin 20 from the intermediate-transfer sheet feeding bobbin 19 is guided by a plurality of guide rollers to pass through the parts of the pinch roller unit U4 and the image transfer means 4.

Furthermore, when the pinch roller unit U4 is rotated toward a platen roller 37 side of the image transfer means 4, the intermediate transfer sheet S2 adheres closely to the platen roller 37 by the operation of two pinch rollers 38. The ink ribbon S1 adheres closely to the left side of the intermediate transfer sheet S2 that adheres closely to the platen roller 37. In this state, by making heater elements of a thermal head 39 of the head unit U3 emit heat selectively, the ink (not shown) of the ink ribbon S1 is melted to move to the intermediate transfer sheet S2. As a result, an image can be obtained.

On the ink ribbon S1, four colors of monochromatic inks consisting of, for example, black, cyan, magenta, and yellow are repeatedly arranged in this order in a longitudinal direction. The ink ribbon S1 moves sequentially in a direction of arrow. Whenever a monochromatic ink is transferred to the intermediate transfer sheet S2 from the ink ribbon Si, the intermediate transfer sheet S2 is rewound on the intermediate-transfer sheet feeding bobbin 19. Thereafter, an operation for transferring a subsequent monochromatic ink on the same image forming region of the intermediate transfer sheet S2 is repeatedly performed while the intermediate transfer sheet S2 is wound on the intermediate transfer sheet winding bobbin 20 from the intermediate-transfer sheet feeding bobbin 19, and thus the four colors of monochromatic inks are sequentially transferred to the intermediate transfer sheet S2. As a result, a full color image 41 is formed on the intermediate transfer sheet S2.

By moving the intermediate transfer sheet S2 and the printed matter M with the same speed while the image transfer roller 40 of the image transfer means 4 having heater elements therein is lowered to make the intermediate transfer sheet S2 adhere closely to the printed matter M of the tray 6, the full color image 41 formed on the intermediate transfer sheet S2 is transferred to the printed matter M. As a result, a printing 42 is performed for the printed matter M.

Further, since the present invention is not limited to the above-mentioned embodiment, various changes and modifications may be made in the invention without departing from the sprit and scope thereof.

For example, the unit fixing means 33 is provided in the pinch roller unit U4, the boss 36 is provided on the head unit U3, the unit fixing means 33 rotates in a counterclockwise direction to be laid horizontally, and the unit fixing means 33 and the boss 36 engage with each other. In this case, the head unit U3 and the pinch roller unit U4 are connected to each other through the unit fixing means 33, the front-side vertical plate 7 of the first detachable unit U1 is pressed by the left end of the unit fixing means 33, and the front-side vertical plate 17 of the second detachable unit U2 is pressed by the right end of the unit fixing means 33. As a result, it is possible to prevent the first and second detachable units U1 and U2 from separating from the main body unit U5 forward.

Furthermore, the unit fixing means 33 may comprise a first connecting means and a second connecting means. The first connecting means is rotatably provided on the front-side vertical plate 7 of the first detachable unit U1. When the first detachable unit U1 is inserted and mounted in the main body unit U5 to rotate, one end of the first connecting means is fitted into a concave portion formed in the head unit U3 and the other end of the first detachable unit is fitted into a concave portion formed in the chassis 1. As a result, it is possible to prevent the first detachable unit U1 from separating from the main body unit U5 forwardly. The second connecting means is rotatably provided on the front-side vertical plate 17 of the second detachable unit U2. When the second detachable unit. U2 is inserted and mounted in the main body unit U5 to rotate, one end of the second connecting means is fitted into a concave portion formed in the pinch roller unit U4 and the other end of the second detachable unit is fitted into a concave portion formed in the chassis 1. As a result, it is possible to prevent the second detachable unit U2 from separating from the main body unit U5 forwardly.

The printed matter M printed by the printing apparatus 100 of the present invention may be cards such as a telephone card and a credit card or may be plates for manufacturing identification.

What is claimed is:

1. A printing apparatus comprising:

a main body unit for performing recording on a recording medium and a first detachable unit, and a second detachable unit provided detachably in the main body unit;

wherein the printing apparatus further comprises an unit fixing means attached to at least one of the main body unit the first detachable unit and the second detachable unit;

wherein the unit fixing means is switched to a lock position to engage with at least one remaining unit so that the first and second detachable units are fixed to the main body unit and to an unlock position at which the first and second detachable units are detachably mounted to the main body unit;

wherein the main body unit comprises a chassis, a head unit for transferring an ink of an ink ribbon on an intermediate transfer sheet serving as the recording medium having an end supported by the chassis in a cantilever manner, and a pinch roller unit for guiding the ink ribbon and/or the intermediate transfer sheet having an end supported by the chassis in a cantilever manner;

the first detachable unit comprises the ink ribbon;

the second detachable unit comprises the intermediate transfer sheet;

the unit fixing means comprises connecting means for connecting or disconnecting the other end of the head unit to or from the other end of the pinch roller unit;

when the unit fixing means is switched to the lock position, the other end of the head unit and the other end of the pinch roller unit are connected to each other through the connecting means so that the first and second detachable units are fixed to the main body unit undetachably; and when the unit fixing means is switched into the unlock position, the other end of the head unit and the other end of the pinch roller unit are disconnected from each other so that the first and second detachable units are detachably mounted to the main body. unit.

2. The printing apparatus according to claim 1, wherein the switching of the lock/unlock positions of the unit fixing means is performed according to a rotation of the unit fixing means; and further comprising a boss located on a unit not having the unit fixing means and wherein the unit fixing means, rotated toward the lock position, engages with the boss.

3. The printing apparatus according to claim 2, wherein an end of the head unit, unsupported by the chassis, engages with a front-side vertical plate of the first detachable unit supported by the main body unit through engagement with the chassis to be supported by the front-side vertical plate of the first detachable unit.

4. The printing apparatus according to claim 1, wherein an end of the head unit unsupported by the chasis, with a front-side vertical plate of the first detachable unit supported by the main body unit through engagement with the chassis to be supported by the front-side vertical plate of the first detachable unit.

5. The printing apparatus according to claim 1, wherein the switching of the lock/unlock positions of the unit fixing means is performed according to a rotation of the unit fixing means.

6. The printing apparatus according to claim 5, wherein an end of the head unit unsupported by the chasis, engages with a front-side vertical plate of the first detachable unit supported by the main body unit through engagement with the chassis to be supported by the front-side vertical plate of the first detachable unit.

* * * * *

UNITED STATES PATENT AND TRADEMARK OFFICE

CERTIFICATE OF CORRECTION

PATENT NO. : 7,195,410 B2
APPLICATION NO. : 10/978240
DATED : March 27, 2007
INVENTOR(S) : Yuuki Yoshida et al.

It is certified that error appears in the above-identified patent and that said Letters Patent is hereby corrected as shown below:

Column 1, line 23, "2. Description of the Related Art For this type of printing" should read --2. Description of the Related Art
For this type of printing--;

Column 6, line 61, "Si" should read --S1--;

Column 7, line 45, "unit. U2" should read --unit U2--;

Column 8, claim 4, line 48, "unit unsupported" should read --unit, unsupported--; and Column 8, claim 4, line 49, "with a front-side" should read --engages with a front-side--.

Signed and Sealed this

Eighteenth Day of December, 2007

JON W. DUDAS
*Director of the United States Patent and Trademark Office*